United States Patent [19]

Roder et al.

[11] 4,217,693

[45] Aug. 19, 1980

[54] CONTROLLED DEPTH SCORING TOOL

[75] Inventors: Hugh H. Roder, Bridgeton; James P. Baum, St. Charles, both of Mo.

[73] Assignee: Boise Cascade Corporation, Boise, Id.

[21] Appl. No.: 29,155

[22] Filed: Apr. 11, 1979

[51] Int. Cl.[3] ..... B26B 25/00; B26D 3/08

[52] U.S. Cl. ..... 30/292; 83/886

[58] Field of Search ..... 83/884, 886, 887; 30/164.95, 292, 307

[56] References Cited

U.S. PATENT DOCUMENTS

| | | | |
|---|---|---|---|
| 1,108,161 | 8/1914 | Field | 30/292 |
| 1,646,918 | 10/1927 | Lenston | 83/886 |

FOREIGN PATENT DOCUMENTS

| | | | |
|---|---|---|---|
| 442786 | 6/1912 | France | 30/307 |

*Primary Examiner*—Jimmy C. Peters

*Attorney, Agent, or Firm*—Lawrence E. Laubscher

[57] ABSTRACT

A scoring tool for forming a scoreline having a predetermined depth in a composite container label layer is disclosed, including an annular scoring blade and a holder assembly supporting the blade for rotation about an axis. The holder assembly includes a blade holder member having an annular portion at one end upon which the blade is mounted, the outer diameter of the annular portion corresponding with the inner diameter of the scoring blade. The blade holder member also has at its other end a flange portion the outer diameter of which is less than that of the blade member. The holder includes an annular locking member for retaining the scoring blade in contiguous relation with the flange portion. The locking member is mounted concentrically about the holder member annular portion, the outer diameter of the locking member being less than that of the flange portion. When the scoring tool is rotated relative to, and is pressed against, the composite container label layer, the scoring blade penetrates the label layer to a depth equal to the distance between the outer radius of the blade and the outer radius of the blade holder member flange portion.

5 Claims, 5 Drawing Figures

Fig. 1
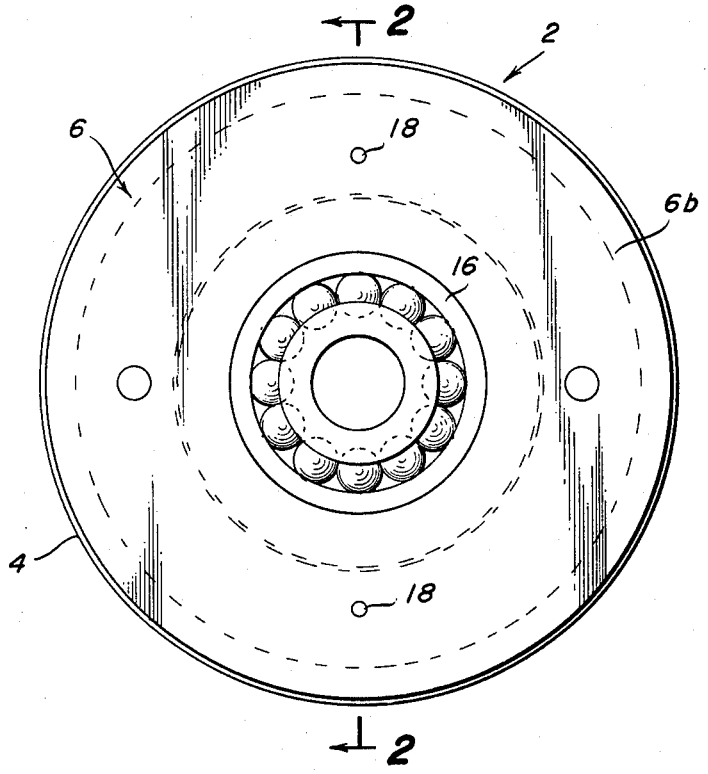
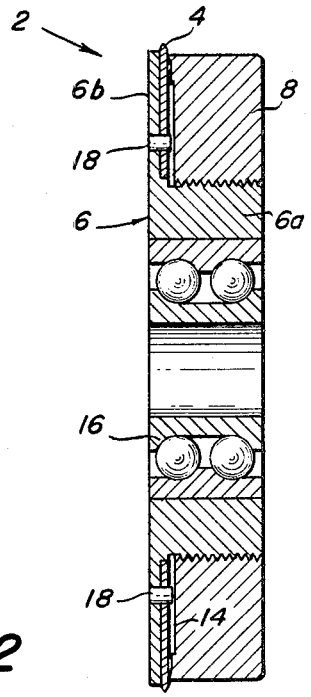
Fig. 2
Fig. 3
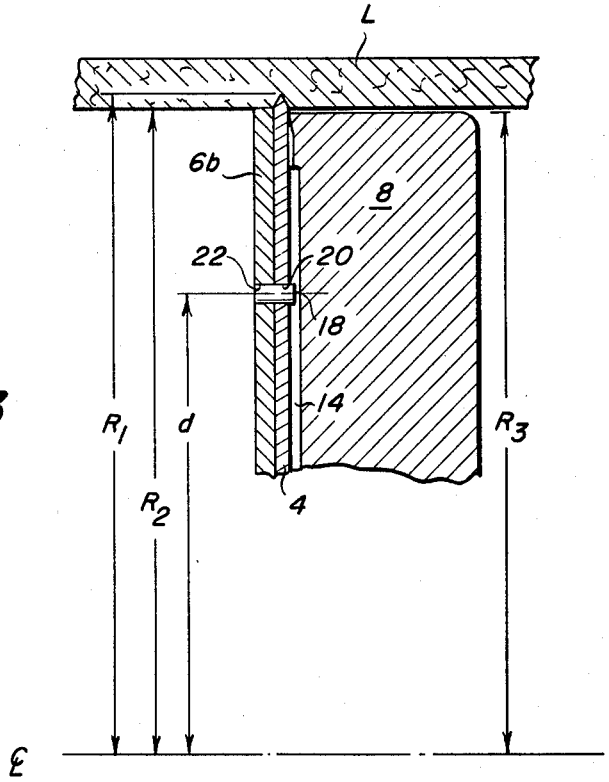

CONTROLLED DEPTH SCORING TOOL

BRIEF DESCRIPTION OF THE PRIOR ART

The use of composite containers for packaging products such as biscuit dough and the like is well known in the patented prior art, as evidenced, for example, by the U.S. Pat. Nos. to Fienup et al. 2,793,126 and Geist et al. 2,793,127 and 3,144,193. As shown in the Geist et al. U.S. Pat. No. 3,144,193, it is conventional in the art to provide in the outer surface of the tubular composite body wall adjacent one metal end closure member a continuous circumferential "collar" cut that extends completely through the label layer to define at one edge portion thereof a triangular-shaped pull tab portion. By means of this pull tab portion the outer label layer may be removed from the body wall to open the container.

These known composite containers possess certain inherent structural and/or functional drawbacks. In the case of composite containers of the collar cut type, the circumferential cut extends completely around the container, thereby intersecting the abutted edges of the helical seam of the fibrous body wall layer to produce a critically weak area adjacent the point of intersection. Thus, the inner liner layer is the only material holding the pressurized product in at that point. Furthermore, when the collar cut is formed in the composite container wall, generally the collar cutting means extends not only through the label layer, but also partially into the fibrous body wall layer (up to a depth of 0.010 inches or more) thereby weakening the body wall of the container circumferentially and also producing fibrous particles which ultimately may contaminate the product. Additionally, in a collar cut container, the moisture formed by condensation on the outer surface of the container penetrates the collar cut and into the fibrous body wall layer, thereby weakening the container strength, and in some cases, causing the container to burst open at the helical seam.

In order to overcome the aforementioned problems inherent in collar cut containers, the Thornhill et al. U.S. Pat. No. 4,091,718 discloses a method and apparatus for providing a tab cut in a composite container label layer prior to winding the label layer onto the fibrous body wall layer. Similarly, the Reid U.S. Pat. No. 4,100,846 discloses a method of forming a composite container in which a partial circumferential collar cut is provided in the label layer immediately prior to winding the label layer on the body wall.

While the prior containers normally operate quite satisfactorily, they still possess some of the inherent drawbacks associated with the use of a collar cut: namely, the critically weak area at the intersection of the collar cut and the abutted edges of the helical seam of the body wall layer, and the contamination and moisture problems.

Thus, it has been proposed to replace the collar cut in the composite container label layer with a scoreline. The present invention was developed to provide apparatus for scoring the label layer of a composite container to a predetermined depth after the label layer has been wound on the container body wall layer. The depth of the scoreline must be accurately controlled so that the scoreline is deep enough to insure that the label is torn along the scoreline during opening of the container, yet not so deep as to intercept the fibrous body wall layer.

SUMMARY OF THE INVENTION

Accordingly, a primary object of the present invention is to provide a scoring tool for forming in a composite container label layer a scoreline having a predetermined depth. Specifically, the tool includes an annular scoring blade and apparatus for supporting the blade for rotation about a given axis. The supporting apparatus includes an annular blade holder member and an annular locking member connected therewith, between which the scoring blade is rigidly held. The blade, blade holder member and locking member are concentrically arranged about the given axis. The outer diameter of the scoring blade is greater than the outer diameter of the blade holder member which in turn is greater than that of the locking member. The depth of the scoreline is thus equal to the difference between the outer radii of the blade and holder member, respectively.

According to a more specific object of the invention, the blade holder member and the locking member are connected by way of a threaded connection.

It is a further object of the present invention to provide a scoring tool including an annular bearing arranged concentrically within the blade holder member allowing for rotation about the given axis.

In accordance with a further object of the invention, the scoring tool includes longitudinally extending locating pin means extending through radially arranged aligned openings contained in the blade and in the holder member, respectively, for maintaining the concentricity of the blade relative to the supporting apparatus.

BRIEF DESCRIPTION OF THE FIGURES

Other objects and advantages of the invention will become apparent from a study of the following specification when viewed in the light of the accompanying drawing, in which:

FIG. 1 is a front end view of the scoring tool;

FIG. 2 is a longitudinal sectional view of the scoring tool taken along line 2—2 of FIG. 1;

FIG. 3 is a detailed sectional view of the outer scoring portion of the tool.

DETAILED DESCRIPTION

Figure 4:
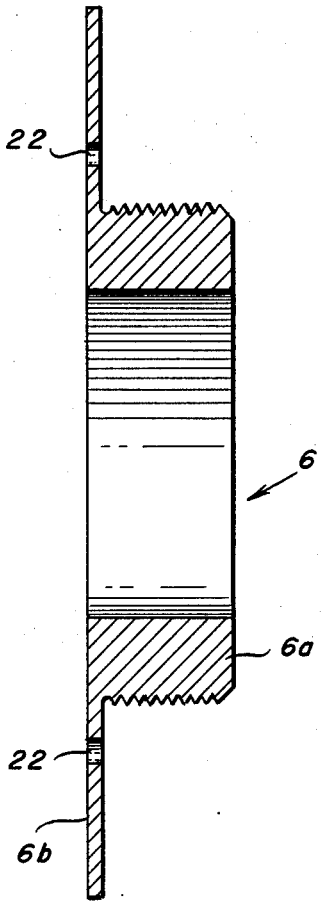
FIGS. 4 and 5 are sectional views of the scoring blade holder member and annular locking member, respectively.
Figure 5:
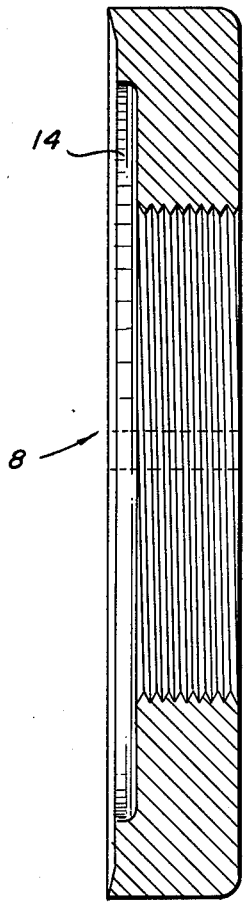

As shown in FIG. 2, the scoring tool 2 of the present invention comprises an annular scoring blade 4 and a blade holder assembly for supporting the blade for rotation about an axis which is parallel to that of the mandrel upon which the composite container is wound. The blade supporting apparatus includes an annular blade holder member 6 and an annular locking member 8. As shown in FIGS. 2 and 4, the annular blade holder member includes at one end an annular portion 6*a*, the outer diameter of which corresponds with the inner diameter of the locking member 8. At its other end the annular blade holder member includes an annular flange portion 6*b*. The annular locking member 8 (FIG. 5) is adapted for mounting concentrically about the blade holder annular portion 6*a*. As will be developed in greater detail below, the face of the locking member 8 adjacent the holder member flange portion 6*b* includes a counterbored recess 14.

Referring again to FIG. 2, the scoring tool assembly may be quickly and easily assembled. The annular scoring blade 4 is mounted concentrically on the blade holder member annular portion 6a in contiguous relation with the blade holder member annular flange portion 6b. The locking member 8 is then mounted concentrically about the blade holder member annular portion 6a for connection with the holder member 6. In a preferred embodiment the blade holder member annular portion 6a and the locking member 8 are threadably connected. When thus assembled, the locking member 8 presses the scoring blade 4 against the blade holder member annular flange portion 6b to maintain the blade in a desired scoring position.

As shown more particularly in FIG. 3, the radius $R_1$ of the scoring blade 4 is greater than the radius $R_2$ of the blade holder member annular flange portion 6b which in turn is greater than the outer radius $R_3$ of the locking member 8. As will be developed in greater detail below, the depth of the scoreline formed in the composite container label layer is equal to the difference between the radius $R_1$ of the scoring blade 4 and the radius $R_2$ of the blade holder member annular flange portion 6b.

The scoring tool 2 may readily be disassembled by unscrewing the annular locking member 8 from the blade holder member annular portion 10 and removing the annular scoring blade 4. Thus, where a blade has become worn, it may be quickly replaced, and furthermore, where a different depth of scoreline is desired, an annular blade having a different radius may be substituted.

The assembled scoring tool 2 includes an annular bearing 16 arranged concentrically within the blade holder member 6 as shown in FIG. 2. The bearing is connected with the blade holder member by any suitable means such as threaded connection (not shown) and facilitates the rotation of the scoring tool about the axis.

In a preferred embodiment illustrated in FIGS. 1 and 3, the scoring tool further includes a plurality of longitudinally extending locating pins 18 which extend through aligned openings 20,22 contained in radially arranged relation in the scoring blade 4 and the blade holder member flange portion 6b, respectively. The locating pins 18 serve to stabilize and retain the scoring blade in precise concentricity relative to the blade holder member 6 during the scoring operation, whereby a predetermined depth of cut is maintained throughout rotation of the scoring tool. As shown in FIG. 3, the locating pins are radially arranged at a distance d from the center of the scoring tool and extend through the scoring blade 4 into the annular counterbored recess 14 contained in the locking member 8, the annular recess having a radius greater than the distance d.

The annular counterbored recess 14 in the face of the annular locking member 8 adjacent the scoring blade 4 affords two functions. First, it provides an area behind the blade for receiving the locating pins 18, and second, it allows the blade to be securely gripped by the locking member 8 adjacent the outer circumferential cutting portion of the blade to provide more accurate scoring.

OPERATION

The scoring tool is adapted for mounting on an automatic cutoff machine arranged along an axis parallel to and adjacent the mandrel upon which a tubular laminate is wound. After completion of the winding operation, the automatic cutoff machine including the scoring tool is applied to the tubular laminate. As the mandrel rotates, the automatic cutoff machine and the scoring tool simultaneously cut the laminate into sections and score the label layers L of each of the sections to a predetermined depth. It is readily apparent that one scoring tool is required for each of the sections to be cut from the length of tubular laminate wound on the mandrel. Thus, a plurality of composite container sections may be cut and scored simultaneously.

During the scoring operation, the outer surface of the blade holder member flange portion rolls along the surface of the composite container label layer while the blade member scores the label layer to the aforementioned predetermined depth. The outer surface of the annular locking member does not come into contact with the container label layer during the scoring operation because of its reduced radius relative to the blade holder member flange portion. Owing to this feature, a clean scoreline is formed in the composite container label layer, whereby bunching of the label layer during scoring is prevented. Furthermore, marking of the label layer is prevented since only a very narrow portion of the blade supporting apparatus (i.e., the width of the blade holder member annular flange portion) actually contacts the label layer during scoring.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A scoring tool for forming in a composite container label layer a scoreline having a controlled predetermined depth, comprising (a) an annular scoring blade;

(b) means supporting said blade for rotation about a given axis, said blade supporting means including (1) an annular blade holder member including at one end an annular portion upon which said blade is mounted, the outer diameter of said annular portion corresponding with the inner diameter of said scoring blade, said blade holder member including at its other end an annular flange portion the outer diameter of which is less than that of said blade member, the outer peripheral surface of said annular flange portion being adapted to abut against the composite container label layer during the scoring operation; and (2) means retaining said scoring blade in contiguous engagement with said flange portion, said retaining means including an annular locking member mounted concentrically about said holder member annular portion in contiguous engagement with a portion of said scoring blade adjacent the outer circumferential cutting portion of said blade, and means connecting said locking member with said blade holder member, the outer diameter of said locking member being less than that of said flange portion, whereby when the scoring tool is rotated relative to, and said annular flange portion is pressed against, said label layer, the outer peripheral surface of said locking member is spaced from, and said scoring blade penetrates into, the label layer to a depth equal to the distance between the outer radius of said blade and the outer radius of said flange portion.

2. Apparatus as defined in claim 1, wherein said means connecting said locking member with said blade holder member comprises a threaded connection between said holder member annular portion and said locking member.

3. Apparatus as defined in claim 1, and further including annular bearing means arranged concentrically within said blade holder member.

4. Apparatus as defined in claim 1, and further including longitudinally extending locating pin means extending through aligned openings contained in said blade and in said holder member flange portion, respectively.

5. Apparatus as defined in claim 4, wherein the face of said locking member adjacent said blade contains adjacent its center a counterbored recess the outer diameter of which is greater than the radial distance between said locking pin means and the axis of rotation of said blade holder member.

* * * * *